US012258771B2

(12) United States Patent
Licau

(10) Patent No.: US 12,258,771 B2
(45) Date of Patent: Mar. 25, 2025

(54) MODULAR TENT SYSTEM WITH REMOVABLE ROOF AND FLOOR

(71) Applicant: Kenneth L. Licau, Hales Corners, WI (US)

(72) Inventor: Kenneth L. Licau, Hales Corners, WI (US)

(73) Assignee: Kenneth L. Licau, Hales Corners, WI (US)

( * ) Notice: Subject to any disclaimer, the term of this patent is extended or adjusted under 35 U.S.C. 154(b) by 183 days.

(21) Appl. No.: 17/777,900

(22) PCT Filed: Nov. 18, 2020

(86) PCT No.: PCT/US2020/061071

§ 371 (c)(1),
(2) Date: May 18, 2022

(87) PCT Pub. No.: WO2021/102010

PCT Pub. Date: May 27, 2021

(65) Prior Publication Data

US 2022/0412118 A1 Dec. 29, 2022

Related U.S. Application Data

(60) Provisional application No. 62/937,447, filed on Nov. 19, 2019.

(51) Int. Cl.
*E04H 15/18* (2006.01)
*E04H 15/30* (2006.01)

(52) U.S. Cl.
CPC ..... *E04H 15/18* (2013.01); *E04H 15/30* (2013.01)

(58) Field of Classification Search
CPC ..... E04H 15/18; E04H 15/30
See application file for complete search history.

(56) References Cited

U.S. PATENT DOCUMENTS 1,650,323 A * 11/1927 Byars ..... E04H 15/00 135/117
2,865,386 A * 12/1958 Burns ..... E04H 15/64 D21/834

(Continued)

FOREIGN PATENT DOCUMENTS

AU 2019100141 A4 3/2019
CN 211874083 U 11/2020
KR 20200001796 8/2020

OTHER PUBLICATIONS

International Preliminary Report on Patentability and Written Opinion for International Application No. PCT/US2020/061071, filed Nov. 18, 2020, dated May 17, 2022, 8 pages.

(Continued)

*Primary Examiner* — Noah Chandler Hawk
(74) *Attorney, Agent, or Firm* — Boyle Fredrickson, S.C.

(57) ABSTRACT

A modular privacy tent system with a removable roof is provided that includes a frame, at least one sidewall, and a removable roof to enable an open top when the removable roof is removed. The modular privacy tent system allows users located within the tent to enjoy the open top while also enjoying the privacy of the sidewalls. The system also includes a variety of security features that prevent individuals located outside of the tent to access the interior of the tent without consent of those located within the tent. These can include anchor planks to which the sidewalls are mounted within the interior, and various clips used with zippers or other attachment devices associated with doors or windows formed in the sidewall. The tent system may also have other features such as modesty clothes that prevent individuals located outside of the tent system from seeing into the interior.

20 Claims, 21 Drawing Sheets

(56) References Cited

U.S. PATENT DOCUMENTS

| | | | | |
|---|---|---|---|---|
| 3,441,037 | A * | 4/1969 | Transeau | E04H 15/003 135/904 |
| 4,112,956 | A * | 9/1978 | Small | E04H 15/00 135/117 |
| 4,719,935 | A | 1/1988 | Gustafson | |
| 6,098,335 | A * | 8/2000 | Brown, Jr. | A01G 9/16 47/17 |
| 6,363,955 | B1 | 4/2002 | Louie | |
| 6,553,725 | B2 * | 4/2003 | Washington | A01M 31/025 446/478 |
| 6,684,584 | B1 * | 2/2004 | Goldwitz | E04H 15/648 52/273 |
| 7,076,922 | B1 * | 7/2006 | Parres | E04B 1/8218 52/79.5 |
| 7,743,781 | B2 * | 6/2010 | Slaughter | E04H 15/001 135/117 |
| 7,766,022 | B2 | 8/2010 | Livacich et al. | |
| 8,056,572 | B2 | 11/2011 | Livacich et al. | |
| 8,397,738 | B2 | 3/2013 | Livacich et al. | |
| D681,146 | S | 4/2013 | Sperry et al. | |
| 8,429,858 | B1 * | 4/2013 | Robinson | E04H 1/005 52/63 |
| 9,316,017 | B1 * | 4/2016 | Slaughter | E04H 15/001 |
| 9,523,213 | B2 | 12/2016 | Pyaga | |
| 9,777,508 | B2 | 10/2017 | Kalvani | |
| 2003/0196690 | A1 | 10/2003 | Chu et al. | |
| 2007/0151589 | A1 | 7/2007 | Holub et al. | |
| 2007/0209694 | A1 | 9/2007 | Gooch et al. | |
| 2008/0006315 | A1 * | 1/2008 | Raniere | A63C 19/12 135/129 |
| 2009/0159109 | A1 | 6/2009 | Zheng | |
| 2011/0155199 | A1 | 6/2011 | Harper et al. | |

OTHER PUBLICATIONS

International Search Report and Written Opinion for International Application No. PCT/US2020/061071, filed Nov. 18, 2020, dated Feb. 22, 2021, 12 pages.

Base Plate 44lbs, https://www.vispronet.com/base-plate-44-lbs? utm_source=google&utm_medium=cpc&utm_campaign=shopping&gclid=Cj0KCQjwrfvsBRD7ARIsAKuDvMPYmE19Tmlml8Ff_dDQbZihunXob3B41MSGCUftbqNMSwdIEt3XpQ8aApdCEALw_wcB, Oct. 11, 2019, 7 pages.

Canopy Weights, https://www.vispronet.com/canopy-weights, Oct. 11, 2019, 8 pages.

Misting Tent—Blue Tent with Mist System—for Outdoor Events—with Low Pressure Misting System—Easy to Set-Up (10' x 10' Blue Tent), https://www.amazon.com/Mistcooling-AMZ31020-MISTCOOLING-Misting-Tent-10-Nozzle/dp/B07DF6FFHG/ref=asc_df_B07DF6FFHG/?tag=hyprod-20&linkCode=df0&hvadid=242053132289&hvpos=1o1&hvnetw=g&hvrand=6546874622092458544&hvpone=&hvptwo=&hvqmt=&hvdev=c&hvdvcmdl=&hvlocint=&hvlocphy=&hvtargid=pla-474142159333&psc=1, Oct. 11, 2022.

Core 6 Person / 9 Person / 10 Person / 12 Person Lighted Instant Cabin Tents, https://www.amazon.com/CORE-Lighted-Person-Instant-Screen/dp/B07GYX4DY5/ref=asc_df_B07GYX4DY5/?tag=hyprod-20&linkCode=df0&hvadid=289607338726&hvpos=1o1&hvnetw=g&hvrand=3772708229364406909&hvpone=&hvptwo=&hvqmt=&hvdev=c&hvdvcmdl=&hvlocint=&hvlocphy=&hvtargid=pla-619213764221&psc=1, Oct. 11, 2019, 10 pages.

Best Lighted Tents, https://familycamptents.com/best-lighted-tents/, Oct. 11, 2019, 26 pages.

* cited by examiner

MODULAR TENT SYSTEM WITH REMOVABLE ROOF AND FLOOR

CROSS-REFERENCE TO RELATED APPLICATION

The present application is a 371 application of international PCT/US2020/061071 filed on Nov. 18, 2020, which claims priority on U.S. Provisional Patent Application Ser. No. 62/937,447, filed Nov. 19, 2019 and entitled Modular Tent System with Removable Roof and Floor, the entirety of both of which is hereby incorporated herein by reference.

BACKGROUND OF THE INVENTION

1. Field of the Invention

This invention relates generally to a tent apparatus, and more specifically, to a tent apparatus having a variety of features to enhance the privacy of users of the tent. For instance, the tent apparatus may have securement devices located within the tent to prevent an outside user from entering the tent without consent from individuals located within the tent. The tent may come equipped with additional materials to further enhance the privacy within the tent, including a modesty cloth panel located at the entrance, as well as flexible wall height extensions that can slant inward and/or outward or straight up that prevent individuals located outside of the tent to look over the top of the tent walls when the roof is off.

2. Discussion of the Related Art

Tents are commonly used for a variety of outdoor activities. For instance, tents are commonly used during camping activities, as well as to provide users with shelter from outdoor elements. Traditional tents oftentimes include a floor, a roof, and sidewalls that are used to form one or more rooms. Usually, the sidewalls have at least one door formed therein that can be opened or closed from the interior or exterior of the tent. Generally speaking, anytime the at least one door is opened, individuals located outside of the tent can view the interior of the tent. Additionally, traditional tents allow individuals located outside the tent to enter the tent without knowledge or consent of individuals located within. In fact, most tents do not have any devices to ensure privacy to individuals located within the tent.

Other open-sided tents can be used during outdoor gatherings to provide users with shade and shelter from rain, snow, and other undesirable weather conditions. While these tents do provide users with cover from above, they do not usually include removable components, such as a removable roof or floor. It may be desirable to have a tent having a removable roof or floor in certain circumstances, for instance, where the users of the tent want exposure to sunlight, or simply want open air above them, such as when the tent surrounds a hot tub or an area used for a physical activity.

Additionally, while traditional tents are capable of being repeatedly torn down, folded up, moved, and set up again, traditional tents usually have a set configuration, and additional components cannot be added to expand the shape of the tent. When a tent is set up, this typically occurs by mounting stakes around the exterior of the tent. While these exterior stakes help to support the shape of the tent, anyone located outside of the tent can easily access the stakes.

Accordingly, there is a need for a tent system that helps to ensure privacy and safety of individuals located therein, while also providing an open roof for various activities. There is also need for a modular tent system where multiple tent sidewalls can be secured to one another where a larger private area is desired.

SUMMARY OF THE INVENTION

In accordance with an aspect of the invention, a modular privacy tent system is provided that includes a frame, at least one sidewall having a top edge and a bottom edge, and a removable roof. The at least one sidewall is releasably supported by the frame to form an interior. The interior has an open top when the removable roof is removed.

In accordance with another aspect of the invention, the at least one sidewall may include a first sidewall, a second sidewall, a third sidewall, and a fourth sidewall. The first sidewall may be releasably attachable to the second and third sidewalls, and the fourth sidewall may be releasably attachable to the second and third sidewalls. Alternatively, the at least one sidewall may include a first sidewall, a second sidewall, a third sidewall, a fourth sidewall, a fifth sidewall, and a sixth sidewall. The first sidewall may be releasably attachable to the second and sixth sidewalls, and the fourth sidewall may be releasably attachable to the third and fifth sidewalls.

According to another aspect of the invention, the tent system may further include a plurality of openings formed along the bottom edge of the at least one sidewall, a plurality of stakes releasably insertable into the plurality of openings, and at least one anchor plank secured to the ground surface with the plurality of stakes. The plurality of stakes may be inserted through the openings into the at least one anchor plank in the interior. The plurality of stakes may be selected from corkscrew stakes and straight stakes. The plurality of stakes may be inserted into the at least one anchor plank at opposing angles to ensure a more secure connection to the ground.

According to yet another aspect of the invention, the system may also include at least one weighted anchor plank that is rested on a ground surface. The bottom edge of the at least one sidewall may be secured to the at least one weighted anchor plank in the interior. The weighted anchor plank may further include a body and an opening formed within the body. The opening is configured to receive a weighted material, for instance water, sand, or any other material.

In accordance with another aspect of the invention, the tent system may include a door formed in one of the at least one sidewall and a modesty cloth located behind the door to prevent visual access to the interior when the door is opened. Additionally, the system may include at least one zipper clip that is mounted to the at least one sidewall in the interior. The door may further comprise a first zipper configured to allow the door to move between an open position and a closed position. In the opened position, access to the interior of the tent system is permitted, whereas in the closed position, access to the interior is not permitted. The zipper clip may be configured to secure the zipper in the closed position.

According to another aspect of the invention, the tent system may include at least one window formed in one of the at least one sidewalls. The at least one window includes a first window covering, a second window covering, and a third window covering. The first window covering may include a portion of the at least one sidewall. The second window covering may include a screen. The third window covering may include a modesty cloth. The second window covering may be located between the first window covering and the third window covering. The modesty cloth may prevent visual access to the interior when the first window covering is released.

In accordance with yet another aspect of the invention, the tent system may also include at least one upper ridge extension lip. The upper ridge extension lip may extend from the upper edge of the at least one sidewall in an upwardly and outwardly direction. The upper ridge extension lip may also include an extender arm and a piece of flexible fabric. For instance, the extender arm may extend from the frame, and be manipulative relative to the frame. As such, the upper ridge extension lip may be movable relative to the frame.

According to another aspect of the invention, the tent system may include other features. For instance, a mister may be mounted to the top edge of the at least one sidewall, and a water source may be connected to the at least on mister. This enables water to be sprayed into the interior. Additionally, at least one light may be mounted to the at least one sidewall. Further still, the frame may include at least one removable roof support member.

According to yet another aspect of the invention, a method of assembling a modular privacy tent system is provided. This may include the steps of assembling a frame, mounting at least one sidewall to the frame, driving at least one stake through a bottom edge of the at least one sidewall, releasably attaching a removable roof to the frame, and removing the removable roof to create an open top. The method may also include the steps of securing at least one stake plate onto a ground surface, and driving the at least one stake through the bottom edge of the at least one sidewall into the stake plate at an interior of the sidewall. The method also may include the steps of driving a first stake through the bottom edge of the sidewall at a first angle and driving a second stake through the bottom edge of the sidewall at a second angle. The first angle may be at least 30 degrees offset from the first angle. Additionally, a first side edge of the at least one sidewall may be releasably attached to a second side edge of another of the at least one sidewall.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

DESCRIPTION OF THE DRAWINGS

Exemplary embodiments of the invention are illustrated in the accompanying drawings in which like reference numerals represent like parts throughout, and in which.

DETAILED DESCRIPTION OF THE PREFERRED EMBODIMENTS

Figure 1:
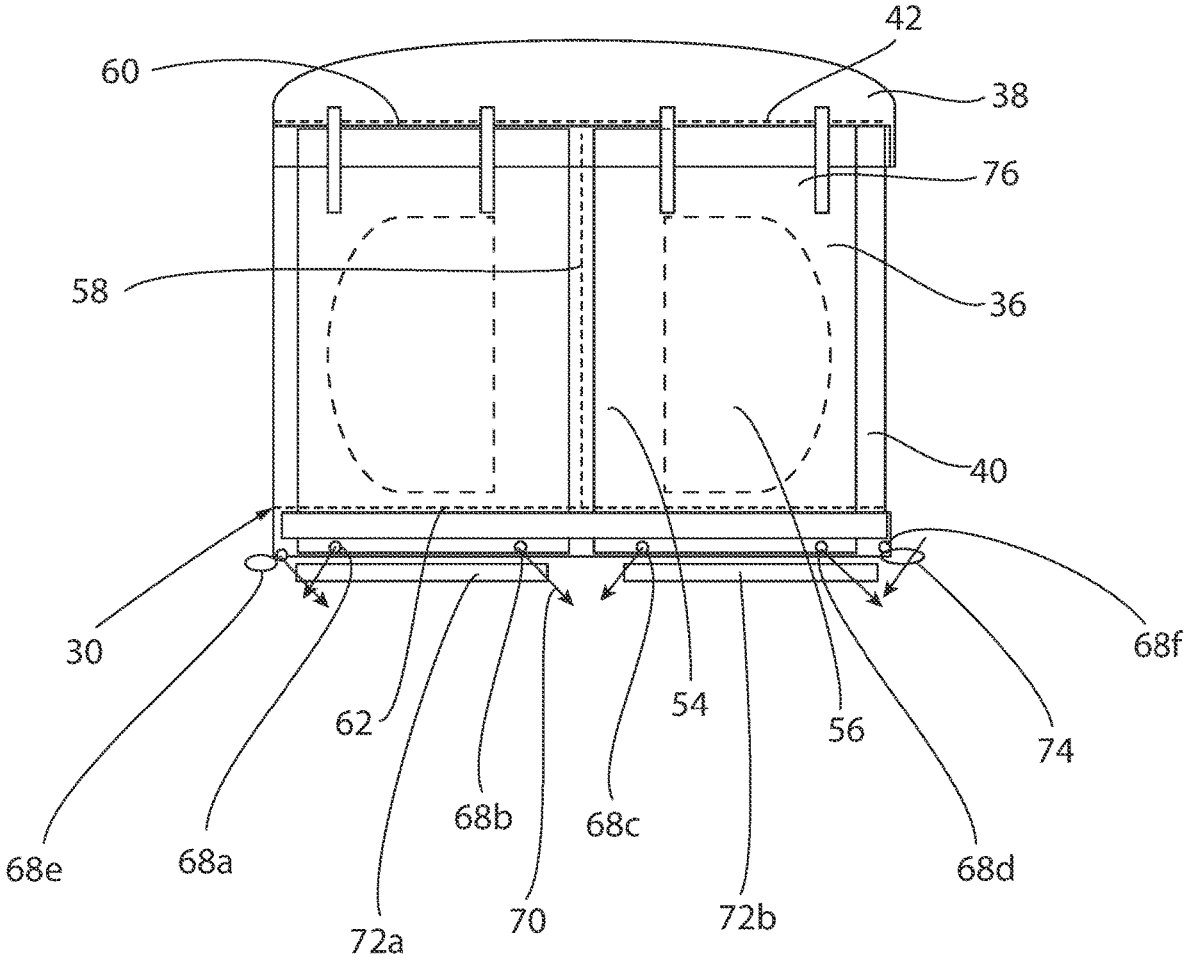
FIG. 1 is a side elevation view of a tent system according to one embodiment of the present invention.

Illustrative embodiments of a tent system or simply a tent (identified generally as 30) in accordance with the present invention are shown in FIGS. 1-9. A similar embodiment is shown in FIGS. 25-28 with some exemplary dimensions. While the invention may be susceptible to embodiments in different forms, there are shown in the drawings, and herein are described in detail, certain illustrative embodiments with the understanding that the present disclosure is to be considered an exemplification of the principles of the invention, and is not intended to limit the invention to those specific embodiments illustrated and described herein. Additionally, features illustrated and described with respect to one embodiment could be used in connection with other embodiments.

The present invention provides a tent system 30 that provides sufficient privacy and security within the tent 30, while also providing an open top 32 to allow access to the sky. More specifically, the tent 30 is designed to provide complete visual obstruction into the tent 30 from individuals outside of the tent 30, while still having an open top 32. For instance, the tent 30 may be used in a variety of settings where users may desire privacy, while also having fresh air, sunshine, or moonlight. This allows users to sunbathe, sit in a hot tub, change clothes, shower, and do various exercises such as yoga, stretching, or Pilates in an outdoor environment without allowing outside third parties to watch. The tent 30 can be used outdoors in a variety of different environments, such as in a user's backyard, on porches and decks, on beaches, in parks, on campsites, and at outdoor areas associated with various hotels and resorts. The tent 30 additionally has components that prevent individuals located outside of the tent 30 from tampering with or entering an interior 34 of the tent 30.

To achieve this goal, the tent 30 may have a plurality of sidewalls 36, a removable roof 38, and a frame 40. As shown in FIGS. 3-7 and 10-12, the tent 30 may have four sidewalls 36 and a removable roof 38. The sidewalls 36 and the roof 38 may be made of a heavy-duty material capable of withstanding significant wind, rain, and other condensation, as well as bugs and other wildlife. The roof 38 can easily be installed or removed from the sidewalls 36 of the tent 30 using a zipper 42 or other fastener. Because the sidewalls 36 are also releasably attachable to one another, the tent 30 may also be used as a canopy (not shown) when the roof 38 is installed but the sidewalls 36 are removed. In other embodiments, the roof 38 need not be included, such that the tent 30 simply consists of the frame 40 and sidewalls 36.

Similarly, the tent 30 may come equipped with a removable floor 44. The removable floor 44 may also be made of a heavy-duty material that can easily be installed or removed using fasteners 46 to keep the outside elements out, and to also reduce the ability for outside users to tamper with the tent 30. As shown, the floor 44 may be installed or removed using any number of different fasteners 46, including a zipper, hook-and-loop Velcro fasteners, snaps, clips, and the like. Once the removable floor 44 has been installed, moisture, bugs, and other wildlife from outside the tent 30 can be kept outside of the tent 30. Additionally, the floor 44 may be configured to hold water therein, for instance, to keep users cool while resting on the floor 44 while sunbathing.

Figure 10:
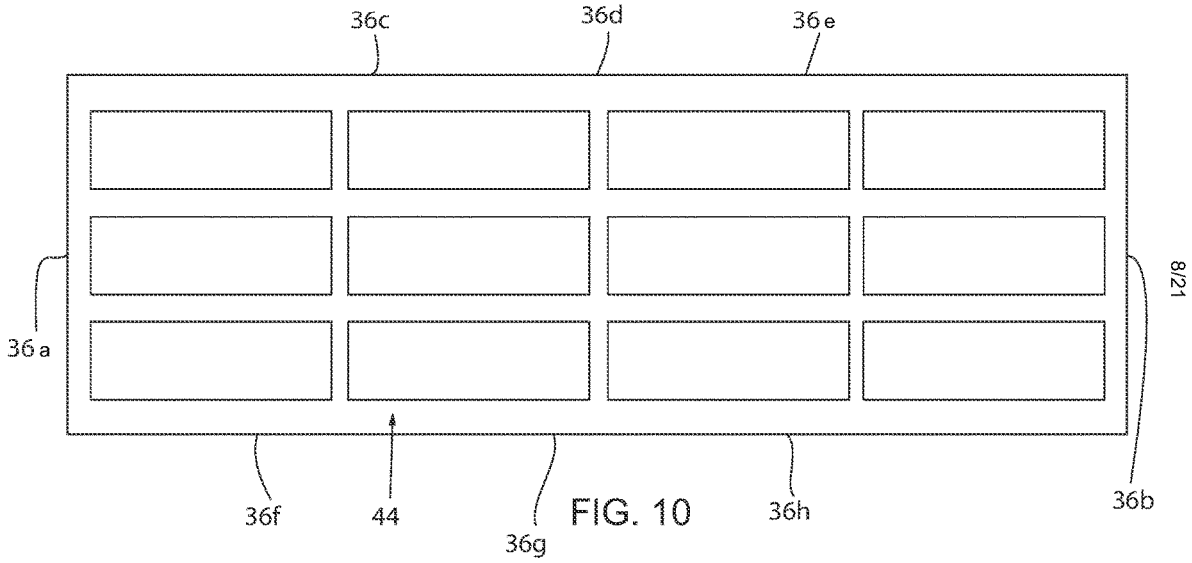
FIG. 10 is a top plan view of another tent system with the roof removed.

The tent 30 may come in a substantially square shape having four sidewalls 36, for instance as shown in FIGS. 1-9. Looking to FIG. 6, the four sidewalls 36*a*, 36*b*, 36*c*, 36*d* may be attached to one another before being secured to the frame 40. Otherwise, the sidewalls 36 may be secured to one another when each is mounted to the frame 40. As shown, each sidewall 36 is approximately 10 feet in length. Alternatively, the tent 30 may come in a substantially rectangular shape, as shown in FIG. 10. Of course, the tent 30 may similarly have additional or fewer sidewalls 36, which would result in tents 30 having other shapes.

Figure 11:
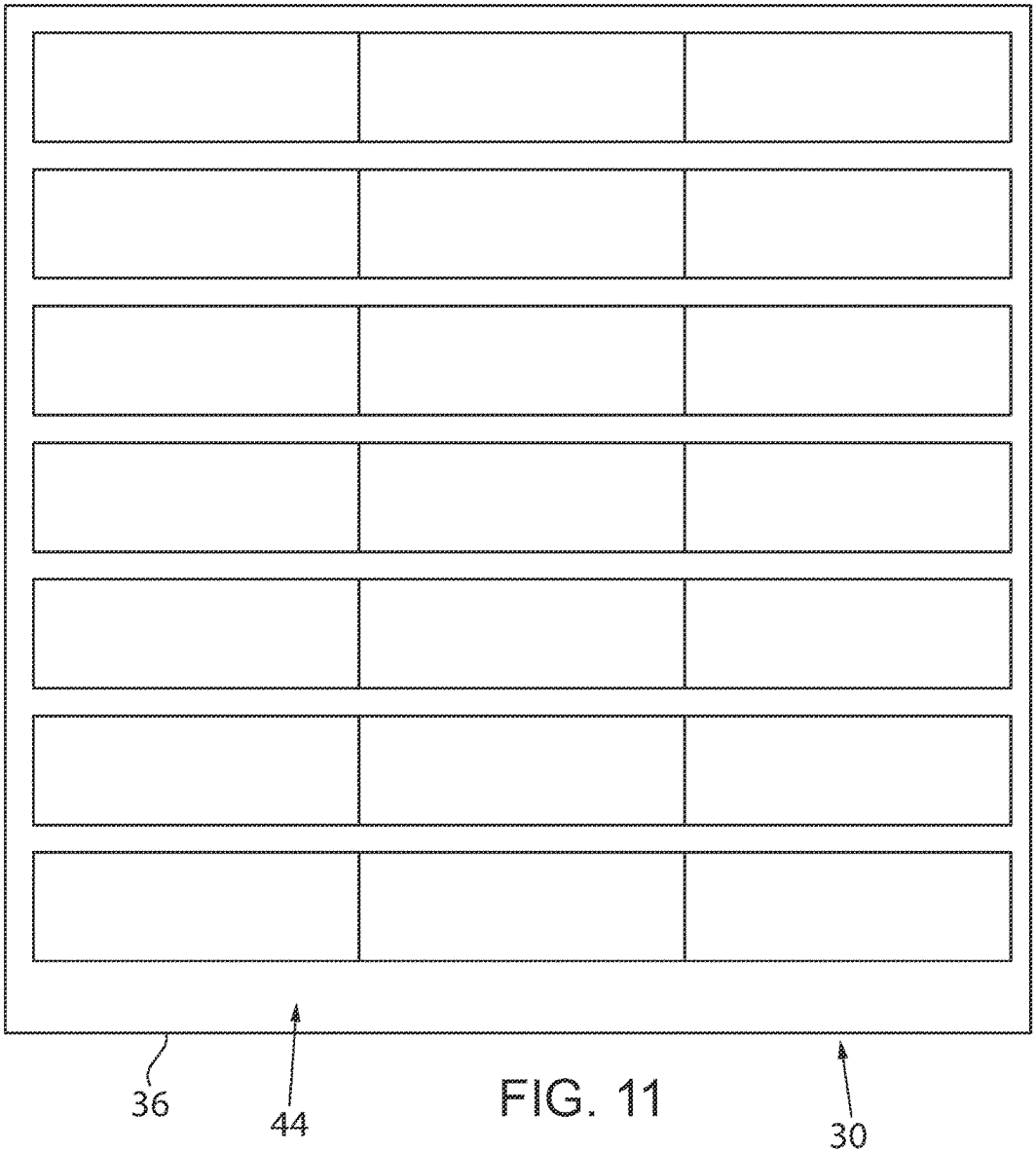
FIG. 11 is a top plan view of another tent system with the roof removed.
Figure 12:
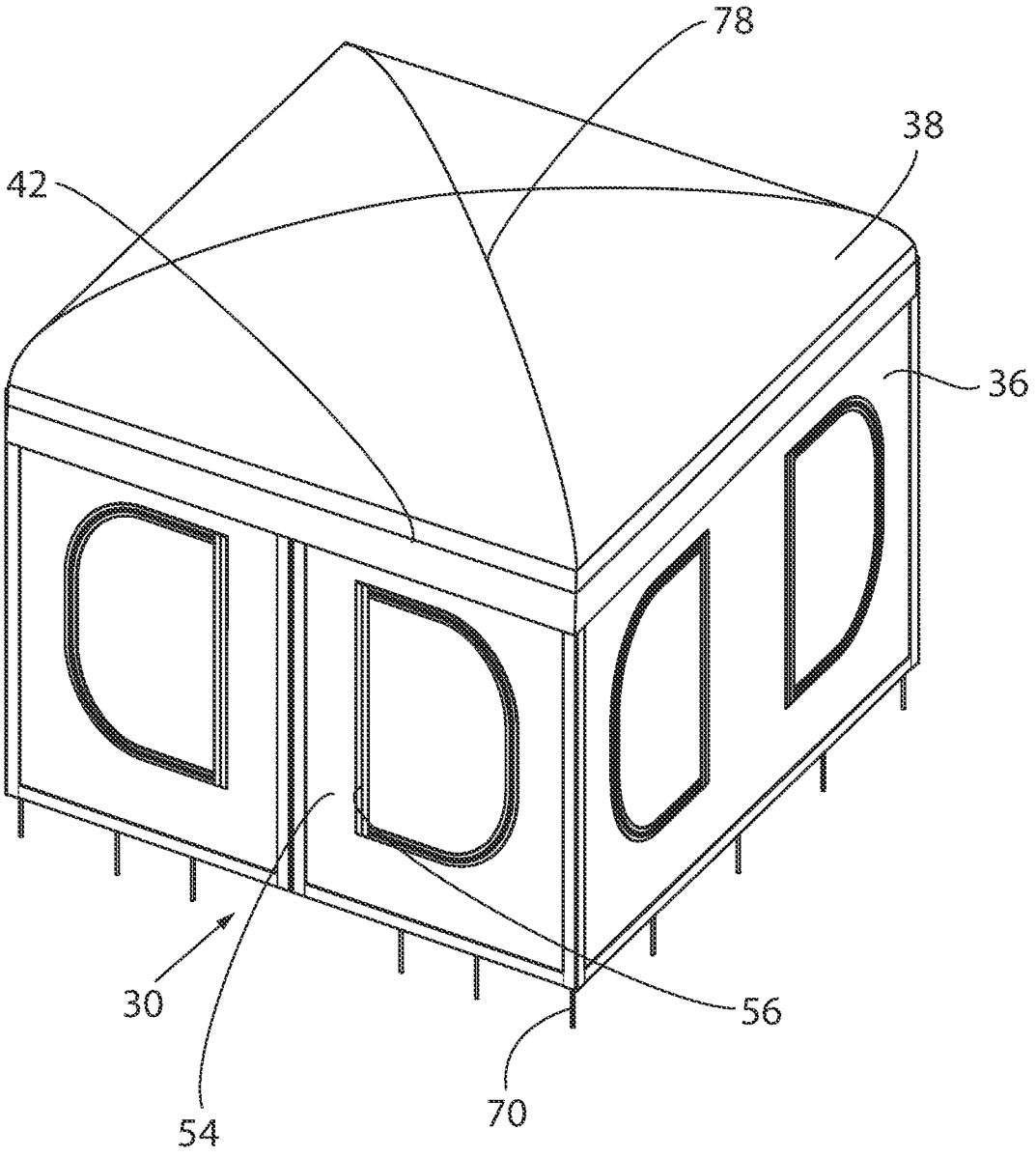
FIG. 12 is an isometric perspective view of the tent system where the sidewalls and roof are attached to a frame.
Figure 13:
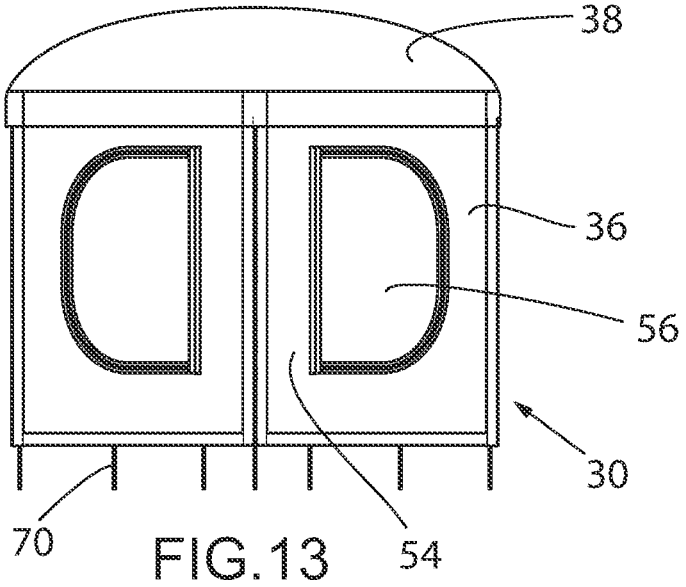
FIG. 13 is a side elevation view of the tent system of FIG. 12.
Figure 14:
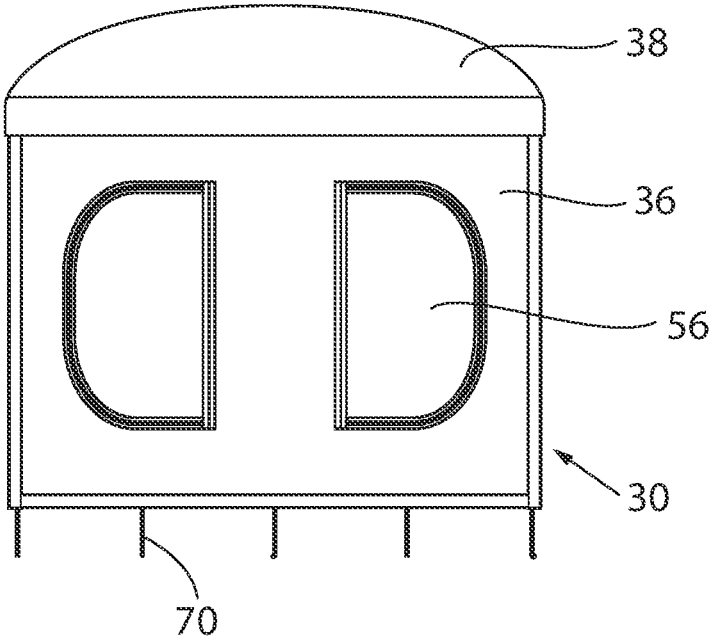
FIG. 14 is a side elevation view of the tent system of FIGS. 12 and 13.
Figure 15:
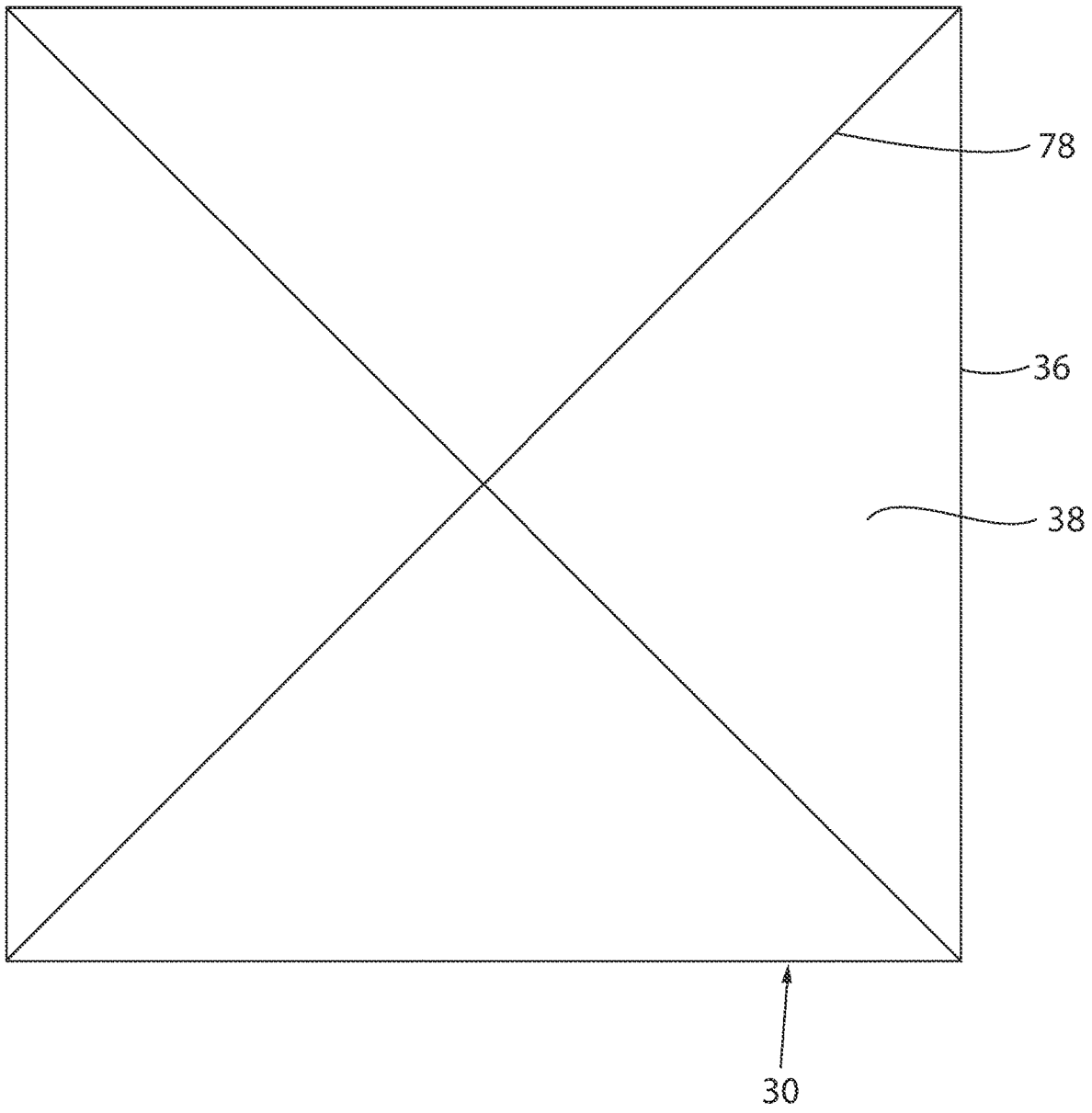
FIG. 15 is a top plan view of the tent system of FIGS. 12-14.

Additionally, the tent 30 may have a modular configuration, such that multiple sidewalls 36 may be attached to one another to create a tent 30 having a larger footprint. For instance, the tents 30 shown in FIGS. 10 and 11 may be formed by attaching multiple sidewalls 36 together. Looking initially to FIG. 10, the tent 30 is formed with each end having a single sidewall 36*a*, 36*b*, whereas the top and bottom sides have three sidewalls 36*c*, 36*d*, 36*e*, 36*f*, 36*g*, 36*h* mounted to one another to create a tent 30 having a width of a single sidewall and a length of three sidewalls. Turning to FIG. 11, the tent 30 has two or three sidewalls 36 attached to one another on each side. Of course, additional sidewalls 36 could be connected to one another to create other shapes. Regardless of the size and shape of the tent 30, the various sidewalls 36 can easily be attached to one another, for instance, using zippers, hook-and-loop Velcro, snaps, clips, and the like (not shown). This would allow a user to have flexibility to either create a smaller tent 30 using only one sidewall 36 per side, or a larger tent 30 including multiple sidewalls 36 per side, while still using the same sidewall materials. Additionally, in these embodiments, multiple frames 40 may be used together in combination with the various sidewalls 36 to support the tent 30. Multiple removable floors 44 may be laid side-by-side within the tent 10 to provide added comfort for users located within the tent.

The tent 30 may also include a variety of privacy features. Initially, the sidewalls 36 may all be made of a material that prevents individuals located outside of the tent 30 to look therein. The material may, however, allow for wind and air to pass therethrough while preventing outsiders from looking in. Further still, the material may allow users located within the tent 30 to partially or fully look through the sidewall 36 out of the tent 30, while preventing outsiders from looking in. Alternatively still, the sidewall 36 material may be a reflective, waterproof material.

Additionally, the sidewalls 36 may have sufficient height to prevent outsiders from looking into the interior 34. As shown, each sidewall 36 may be at least seven feet tall, and in some embodiments, even taller. Where the tent 30 is used during sunbathing, the various sidewalls 36 may also be movable to ensure sufficient access to direct sunlight. For instance, in the morning or evening, one or more of the sidewalls 36 can be adjusted or removed to allow for sunlight to enter the interior of the tent, while still maintaining a certain level of privacy from outsiders. This may occur by adjusting portions of the frame 40 in a downward direction, which results in the tent 30 being slanted relative to the ground. This is especially desirable when the length of days is shorter or during seasons when the sun is located an extreme northern or southern position.

Figure 16:
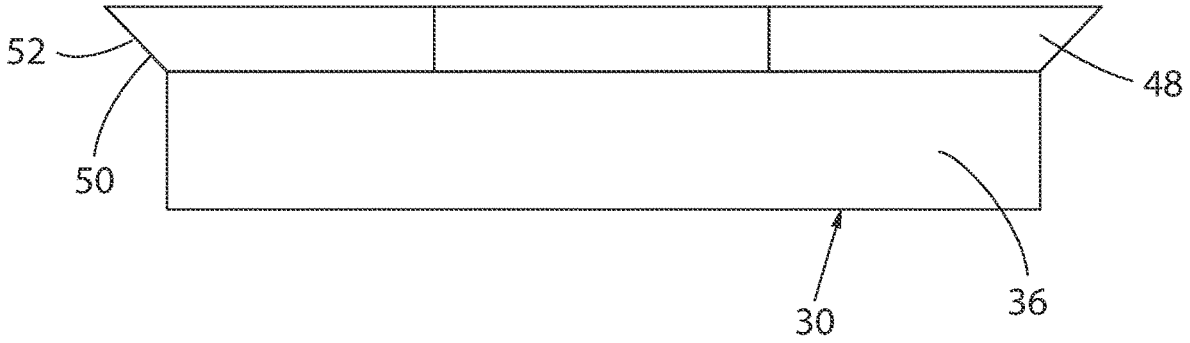
FIG. 16 is a side elevation view of another tent system.

In addition to the height of the sidewalls 36, the tent 30 may have additional components to prevent outsiders from attempting to look into the tent 30. As shown in FIG. 16, the tent 30 may be equipped with an upper ridge extension lip 48 that extends upwardly, inwardly and/or outwardly from the top of the sidewall 36. For instance, four upper ridge extension lips 48 may be installed onto the tent 30, with each upper ridge extension lip 48 associated with one of the sidewalls 36. The upper ridge extension lip 48 may be supported by various frame components that can be installed relative to the sidewalls 36. For instance, the upper ridge extension lips 48 may connect to the legs of the frame 40. More specifically, built in sleeves 50 may be located at either end of each upper ridge extension lip 48 that can be slid onto each leg of the frame 40. As shown, the upper ridge extension lips 48 are at an angle of approximately 45 degrees relative to the vertical. However, the upper ridge extension lips 48 may also be adjustable to different angles based on the preference of users. This may be achieved by having the upper ridge extension lip 48 include extension fabric that is elastic, in combination with extender arms 52 that are adjustable relative to the frame 40. For instance, the upper ridge extension lip 48 may be adjusted so that it provides at least some shade into the interior 34 of the tent 30. This upper ridge extension lip 48 makes it more difficult for individuals located outside of the tent 30 from standing, jumping, or climbing in such a way as to peer over the top of the sidewalls 36, while also importantly not impeding sunlight from entering the interior 34 of the tent 30. In the event that the upper ridge extension lip 48 is not used, the material extending from the sidewalls 36 can simply fall downwardly and abut against the various sidewalls 36.

Figure 17:
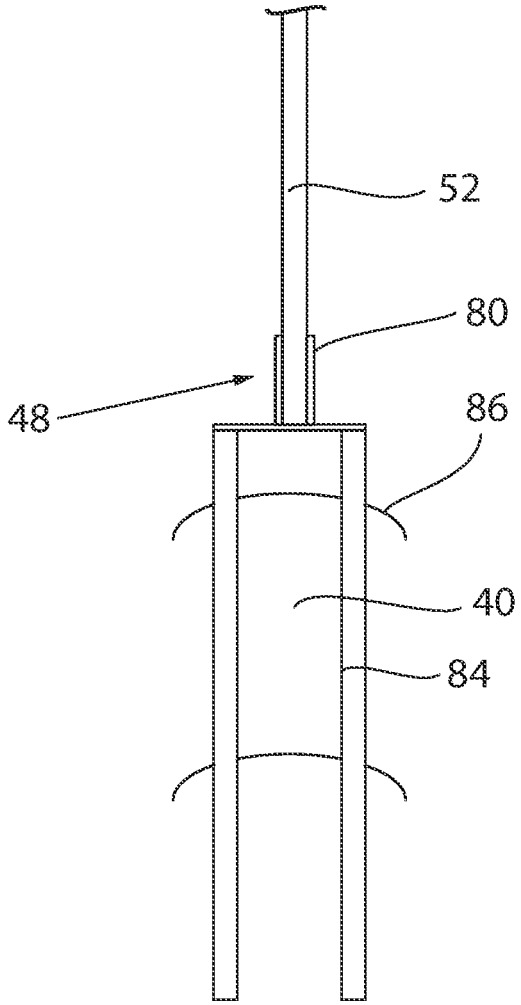
FIG. 17 is a side elevation view of a upper ridge extension lip.
Figure 18:
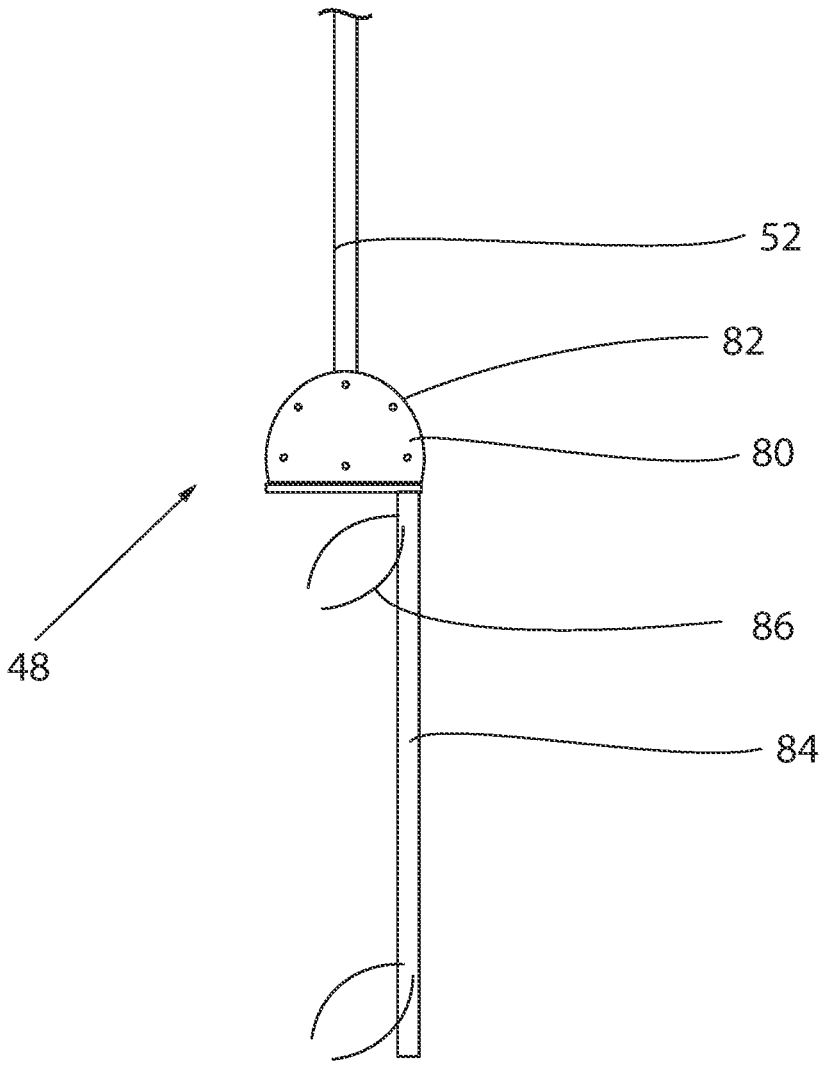
FIG. 18 is another side elevation view of the upper ridge extension lip of FIG. 17.
Figure 19:
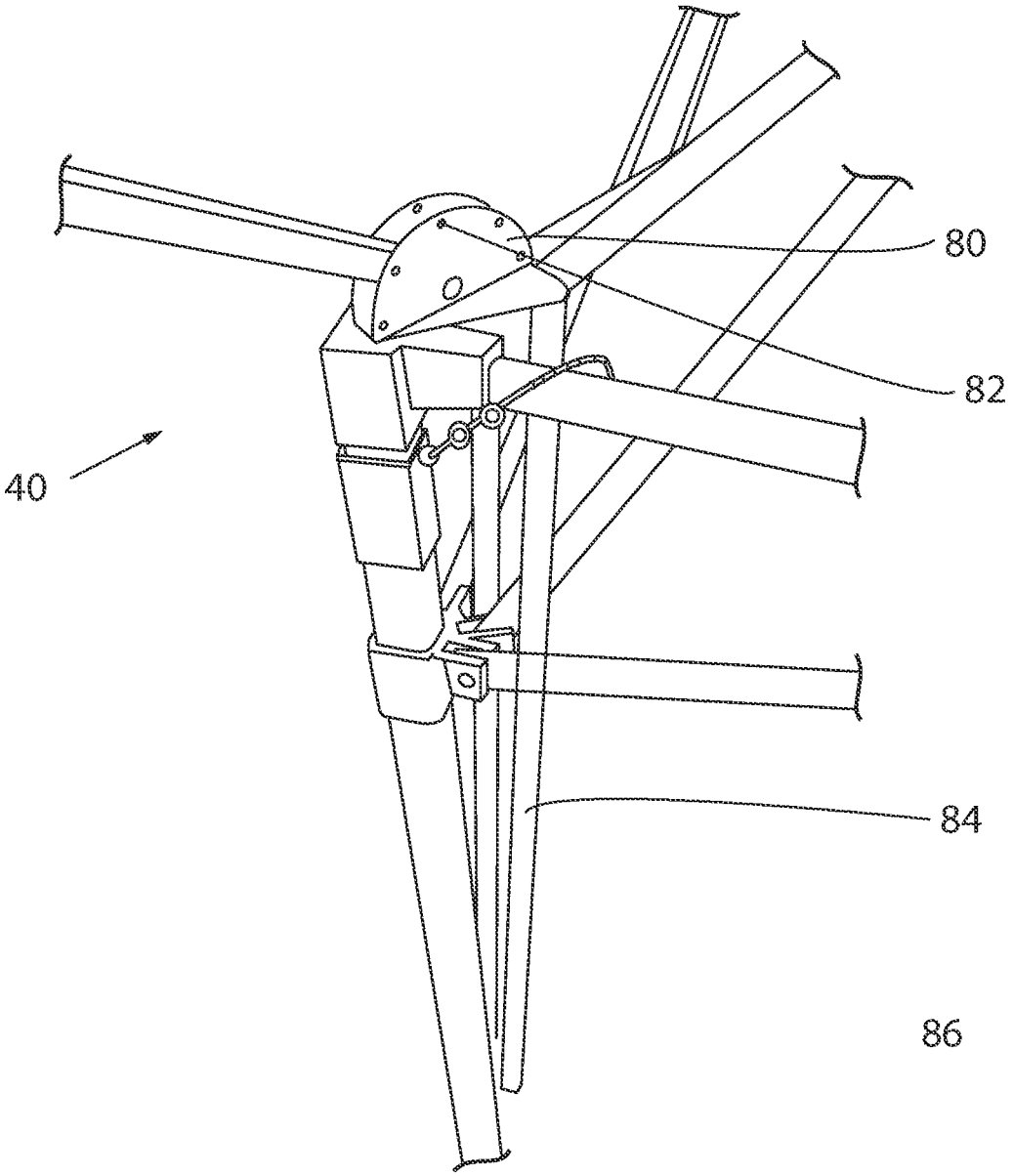
FIG. 19 is a perspective view of the frame and upper ridge extension lip of FIGS. 17 and 18.
Figure 20:
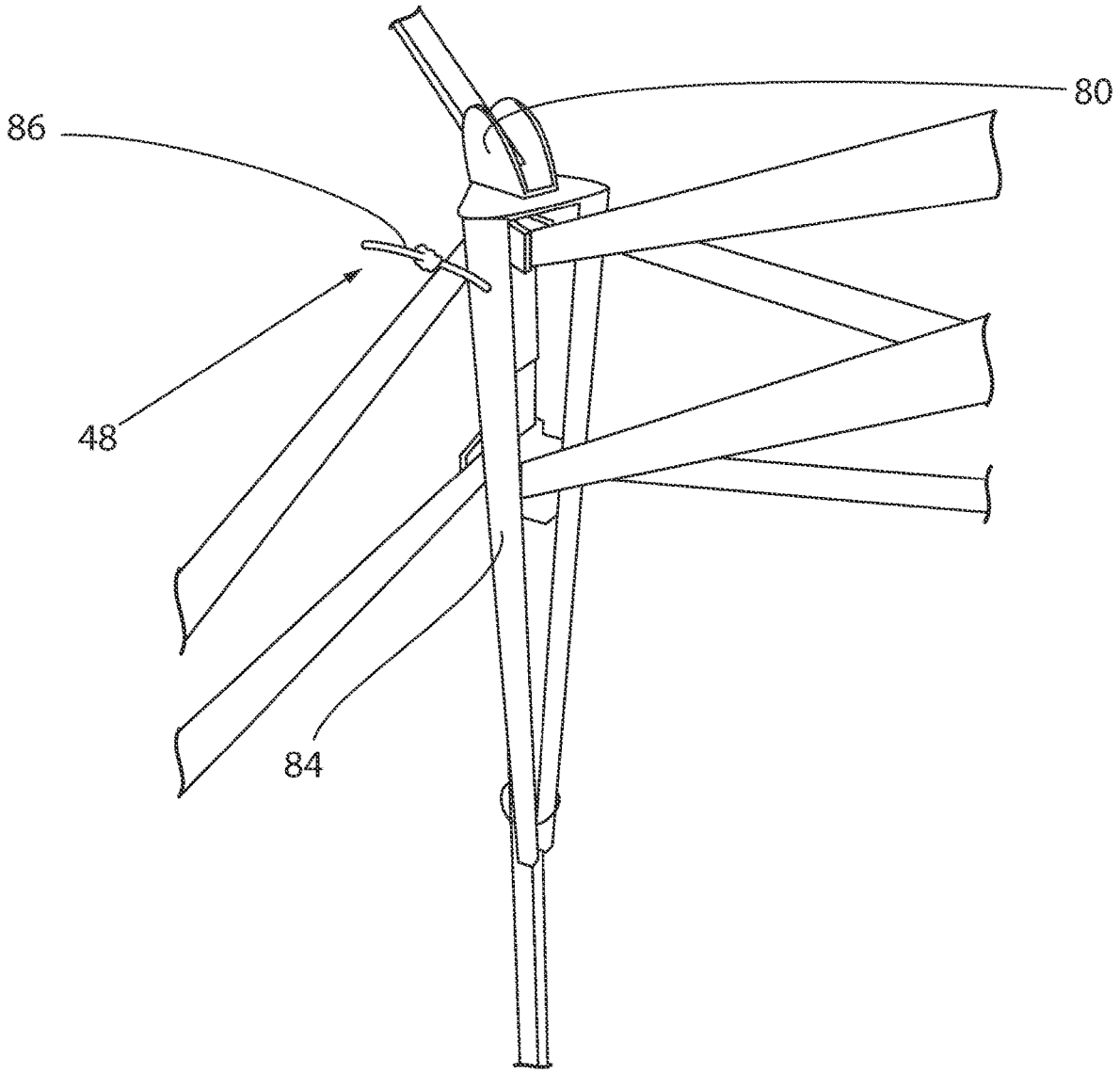
FIG. 20 is a perspective view of the frame and upper ridge extension lip of FIGS. 17-19.
Figure 21:
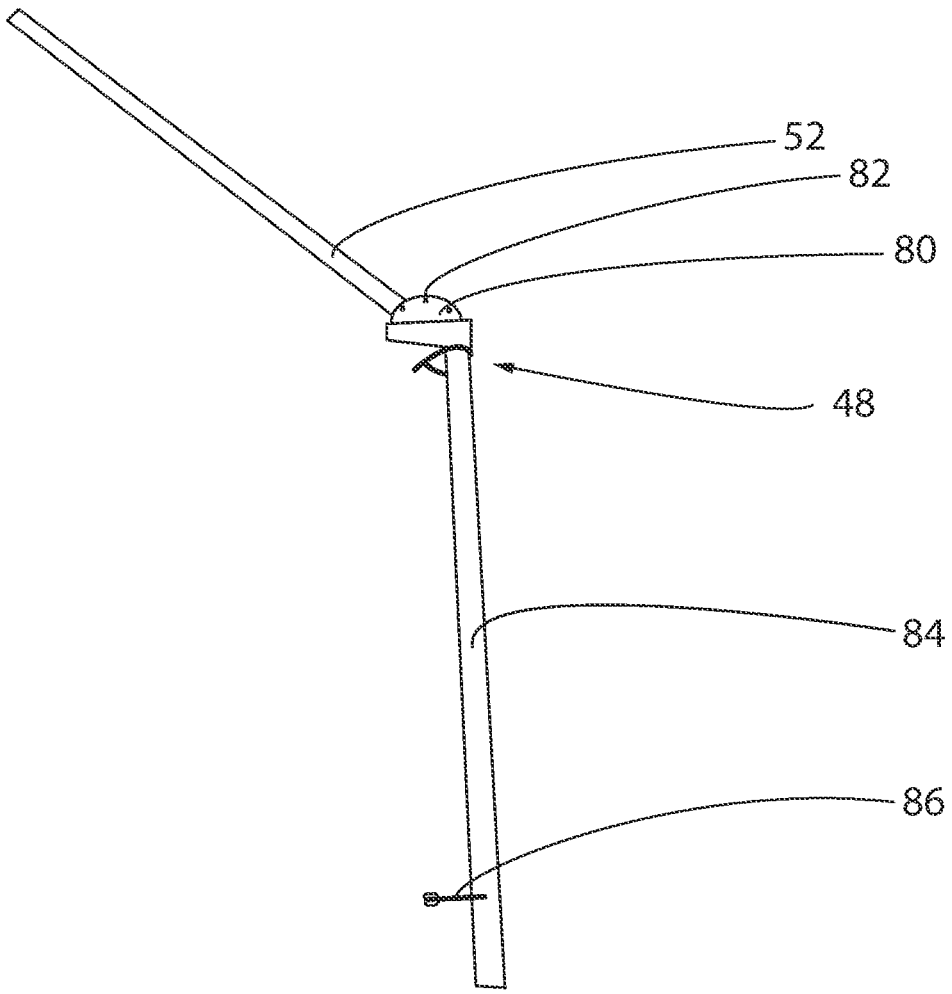
FIG. 21 is another side elevation view of the frame and upper ridge extension lip of FIGS. 17-20.

Additionally, FIGS. 17-21 provide additional views of one potential embodiment of the upper ridge extension lip 48. FIG. 17 provides a front view and FIG. 18 provides a side view of the upper ridge extension lip 48. The upper ridge extension lip 48 includes a base 80 to which the arm 52 is adjustably mounted to. For instance, the arm 52 may be adjusted relative to the base 80 using any of the openings 82 formed therein. As seen in FIG. 18, the base 80 may include openings 82, such that the arm 52 may be mounted horizontally into or out of the tent 30, vertically relative to the tent 30 as shown in FIG. 18, or at 45 degree angles inside or outside of the tent 30. This can be achieved by inserting a pin (not shown) into the relevant opening 82 and through the arm 52. Additionally, the base 80 may be attached to at least one leg 84 that extends downwardly and connects to the frame 40. For instance, as shown each upper ridge extension lip 48 has two legs 84 that can be secured to the frame 40. Additionally, the upper ridge extension lip 48 may include fasteners that can be used to secure the legs 84 to the frame. By way of example, as seen in FIGS. 19-21, the fasteners may be zip ties 86 that can releasably secured to the legs 84 and wrapped around the frame 40 to ensure secure connection of the upper ridge extension lip 48 to the frame 40.

As shown in FIG. 1, the tent 30 may be equipped with a front door 54, where there is a vertical zipper 58, a top horizontal zipper 60, and a bottom horizontal zipper 62. At either end of each zipper, waterproof housings (not shown) may be provided in which the zipper can be slid.

Additionally, one or more of the sidewalls 36 may have optional screened windows 56 formed therein, each of which have a zipper with two sliders which can be spaced apart to allow for a vent or breezeway while still allowing privacy. For instance, the windows 56 may include a first window covering 64 made of the same material as the sidewall 36, a second window covering 65 made of a screen, and a third window covering 67 made of a modesty cloth, which may be reflective. The first window covering 64 may be opened such that it falls away from the window opening 56 to expose the screen. This can help to improve air circulation within the tent 30. In the event that users within the tent 30 still wish to have privacy, the modesty cloth can provide partial or full coverage over the screen. For instance, the modesty cloth may extend along the window 56 on the inside of the tent 30 so that even when the first window covering 64 is opened, there is still a desired amount of privacy. Similar modesty clothes may be provided where the doors 54 are located.

The tent 30 may include various security components to ensure that it is tamperproof from the outside, preventing outsiders from trying to gain access into the interior 34 of the tent 30 without consent of individuals located therein. For instance, all fasteners associated with doors 54 and windows 56 of the tent 30 may be located on the inside of the tent 30. While the fasteners will be described as zippers herein, it should be noted that any other fastener could similarly be used, include hook-and-loop Velcro fasteners, snaps, clips, and the like.

Alternatively, the fasteners may be operable both inside and outside of the tent 30, with additional locking mechanisms located within the tent 30 to prevent unauthorized use of the fasteners from outside of the tent 30. For instance, the tent 30 may include zipper clips 66, such as carabiners or other clips, that are located within the tent 30 at endpoints of each zipper. The zipper clips 66 may be clipped to the zippers when the zippers are in a closed position. As a result, the zippers cannot be moved until the clip 66 is disengaged. Because the zipper clips 66 are located within the tent, an outsider cannot disengage the clips 66.

In order to secure the tent to the ground, various openings 68 may be formed in the bottom of the sidewalls 36. For instance, to prevent access by outside parties, the sidewalls 36 may be secured to the ground from the inside of the tent 30. As shown, four openings 68*a*, 68*b*, 68*c*, 68*d* are formed along the bottom of each sidewall 36, with two additional openings 68*e*, 68*f* formed in either end of the sidewall 36. Of course, additional or fewer openings may be used depending on the dimensions of the sidewall 36, the configuration of the tent 30, and any other relevant factors.

Stakes 70 may be installed around the tent 30 in order to keep the bottom of each sidewall 36 secured to the ground. In addition to simply driving stakes 70 through the openings 68 into the ground, the tent 30 may also have stake planks/stake plates/anchor planks 72 that are secured to the ground. In this way, the stakes 70 may be driven through the openings 68 and into the stake plates 72. The stakes 70 may be driven directly into the stake plates 72, or the stake plates 72 may have additional openings (not shown) formed therein configured to receive the stakes 70. For instance, two stake plates 72*a*, 72*b* may be used to secure each sidewall 36 to the ground as seen in FIG. 1. The stake plates 72 may be in a variety of different dimensions, again depending on the size of the tent 30, the dimensions of the sidewalls 36, the conditions of the ground, the amount of wind and other adverse weather conditions in a given area, and other similar factors. Additionally, four straps 74 may be provided at each of the corners of the tent 30. These straps 74 may be used when the floor 44 is included with the tent 30, and the feet of frame 40 are located on or inside the floor. Stakes may be driven through these straps 74 outside of the tent 30 at each corner because the stakes cannot be driven through the feet. Even if someone removes the stakes from the straps 74 outside of the tent 30, access to the interior 34 of the tent 30 is still prevented since the floor 44 is zipped in.

Figure 2:
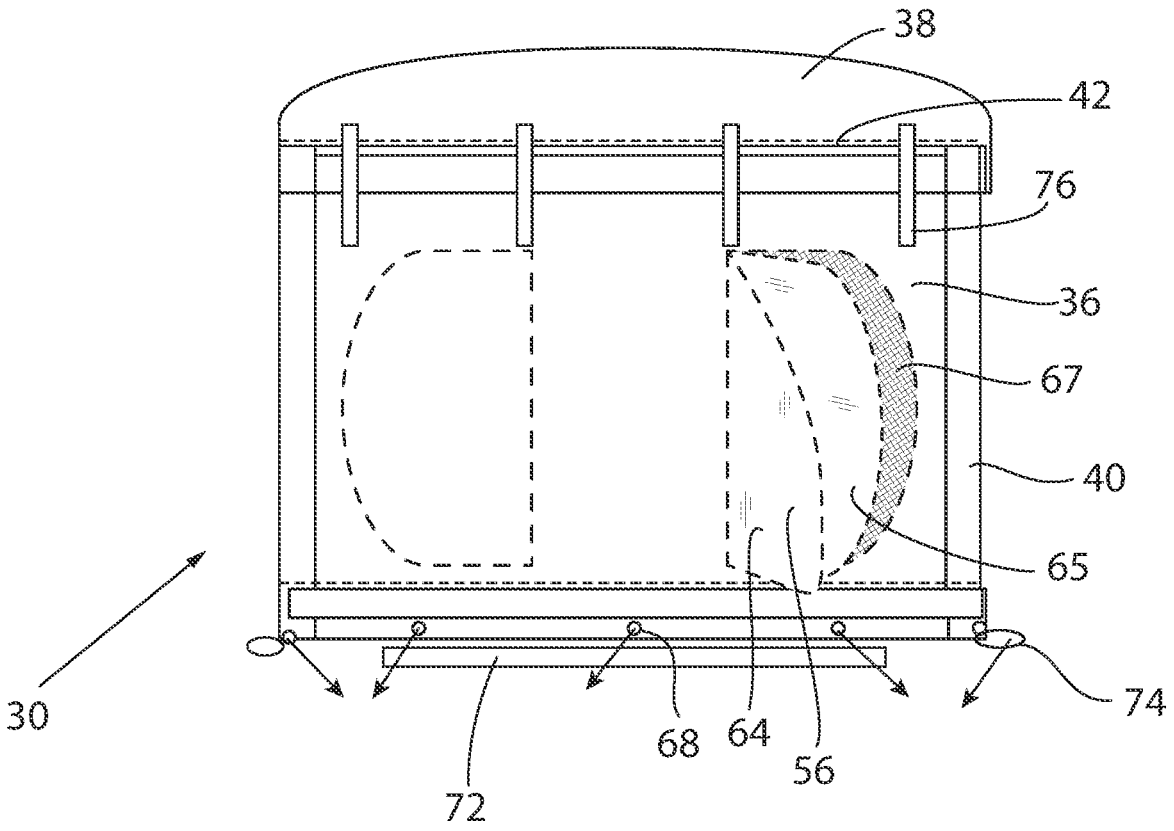
FIG. 2 is another side elevation view of the tent system of FIG. 1.
Figure 6:
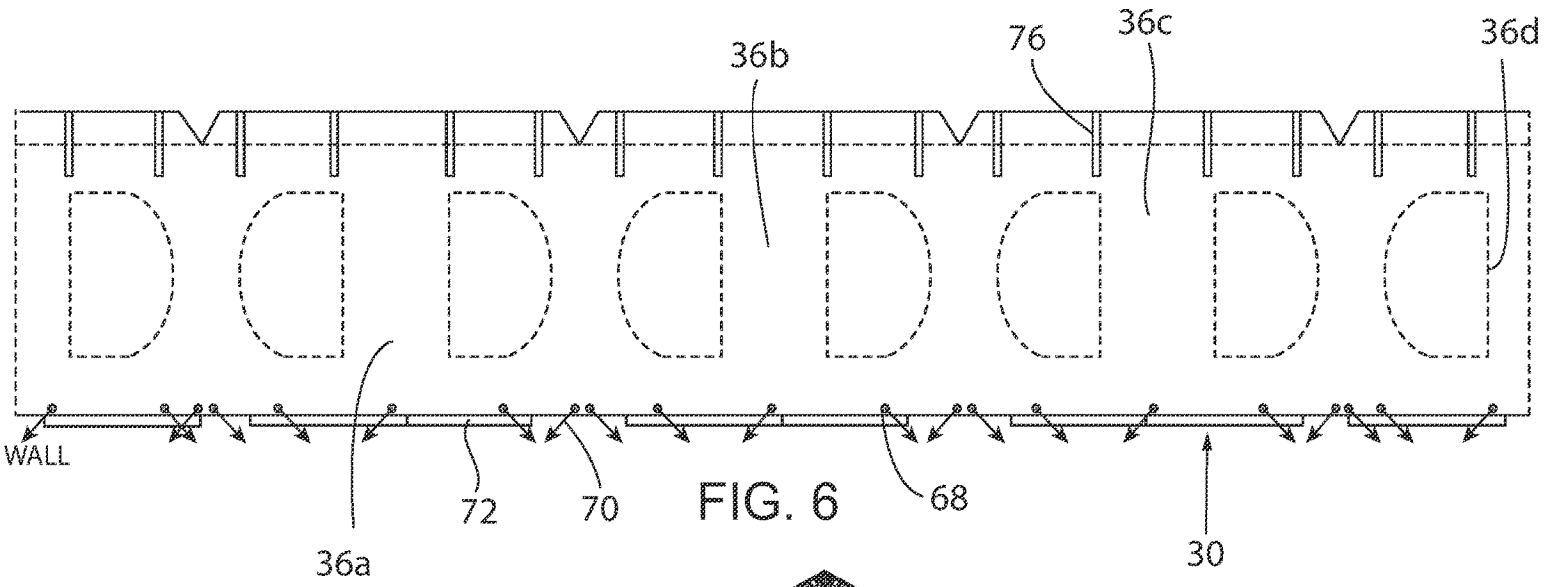
FIG. 6 is a side elevation view of a tent system where multiple sides are aligned prior to installation on a frame.
Figure 7:
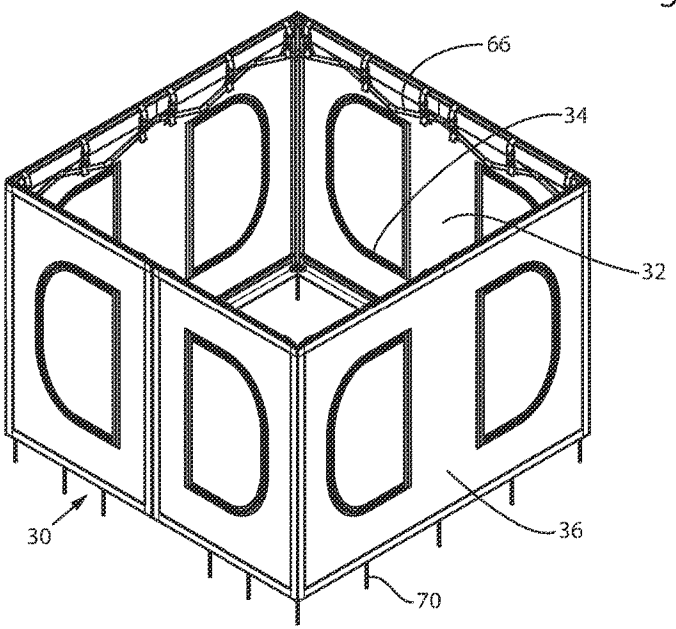
FIG. 7 is an isometric perspective view of the tent system where the sidewalls are attached to a frame and the roof is removed.
Figure 8:
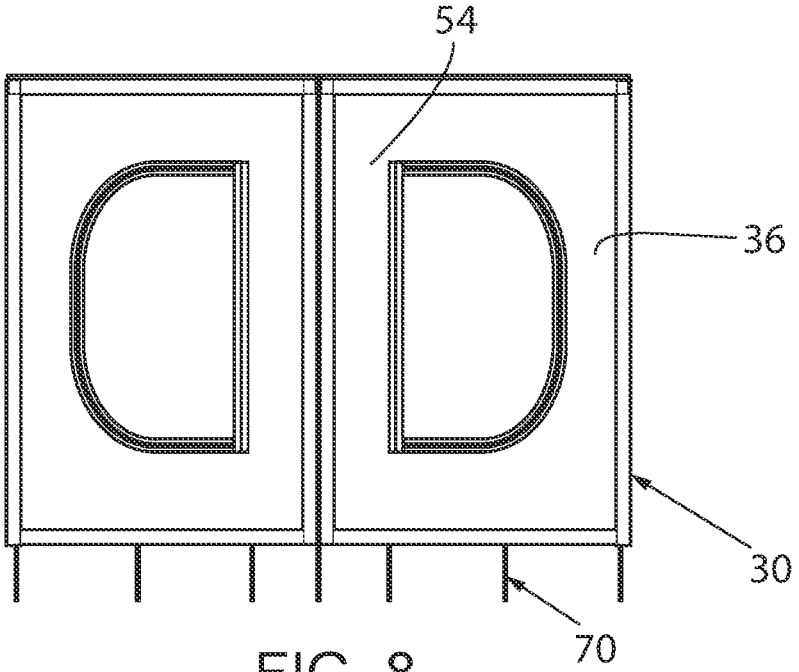
FIG. 8 is a side elevation of another embodiment of the tent system.
Figure 9:
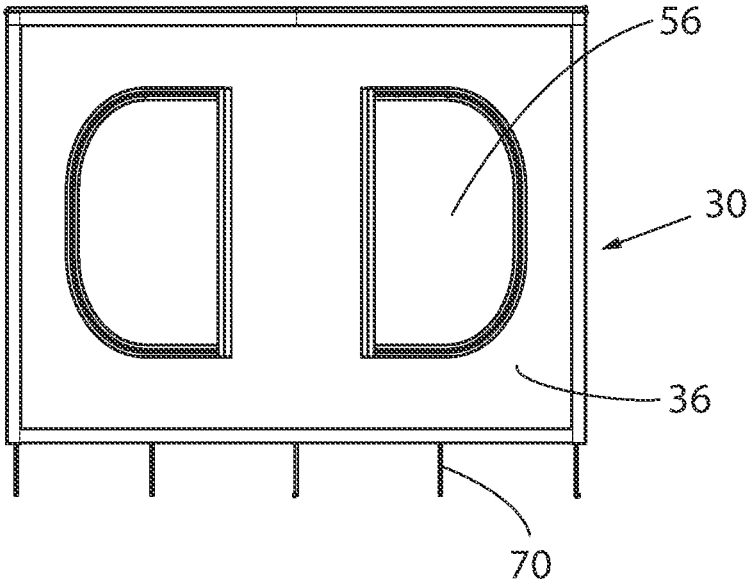
FIG. 9 is another side elevation of the tent system of FIG. 8.

A variety of different stakes 70 may be used. For instance, spiral stakes (not shown) may be used as these provide the most secure connection with the ground. Otherwise, straight stakes may be used, as shown in the figures. When straight stakes 70 are used, preferably each stake 70 is driven into the ground and/or stake plate 72 at angles to result in the crisscross formation as seen in FIGS. 1, 2, and 6. By driving the stakes 70 in at these angles, the tent 30 is more securely attached to the ground to make it even more difficult for someone located outside of the tent 30 to pull up any of the sidewalls 36. Additionally, ensuring that the tent 30 is secured to the ground helps to avoid damage or movement of the tent 30 due to wind or other elements. As a result, there is no need for additional support structure to be located outside of the tent 30.

Figure 22A:
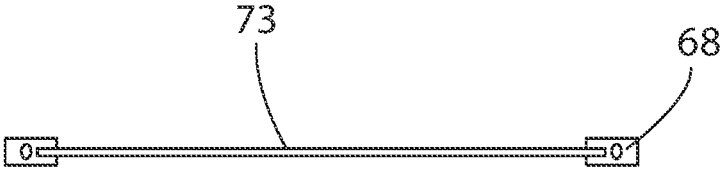
FIGS. 22*a* and 22*b* includes various side and plan views of a weighted stake plank.
Figure 22B:
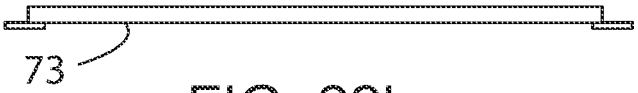
Figure 23:
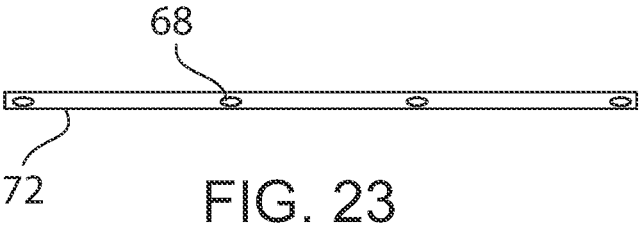
FIG. 23 is a plan view of a stake plank.
Figure 24:
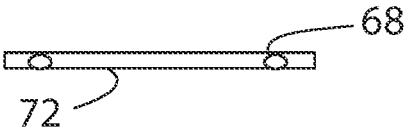
FIG. 24 is a plan view of another stake plank.
Figure 25:
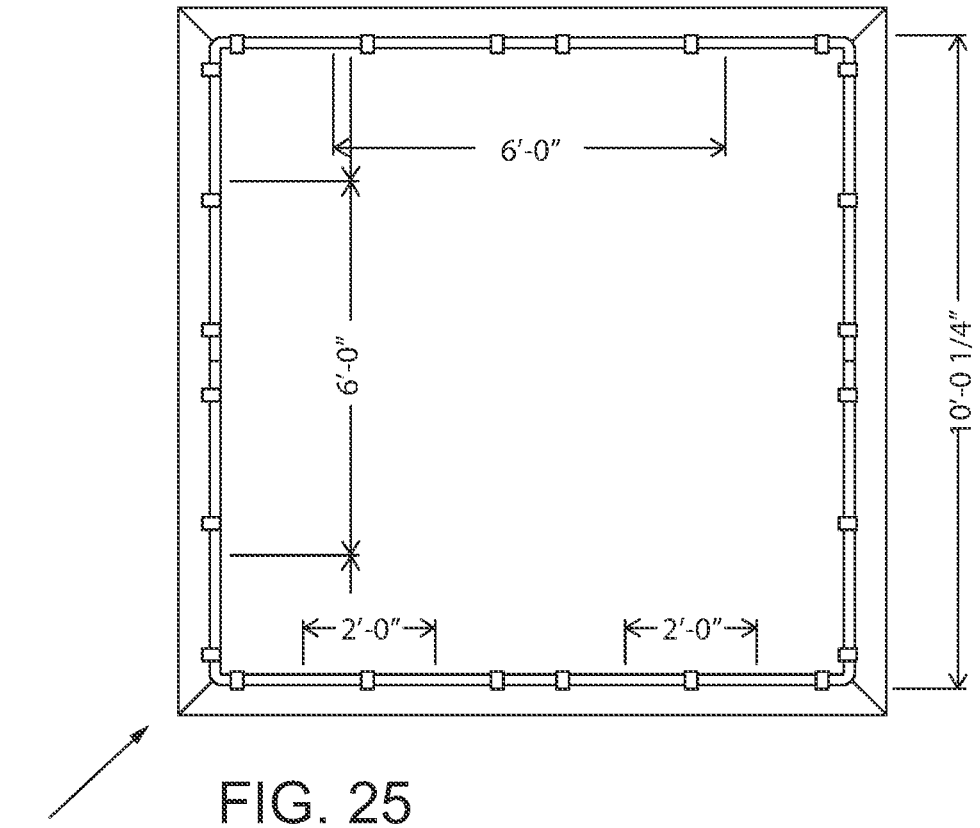
FIG. 25 is a top plan view of a tent system with a roof removed with potential dimensions.
Figure 26:
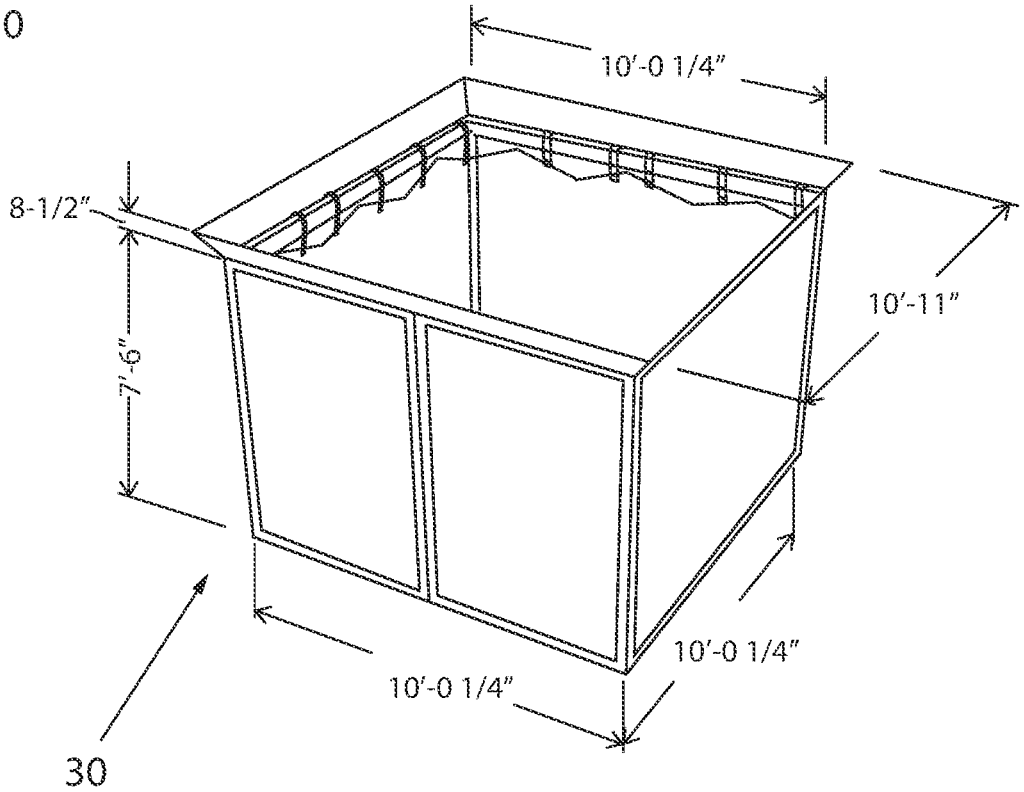
FIG. 26 is an isometric perspective view of the tent system of FIG. 25 with a roof removed with potential dimensions.
Figure 27:
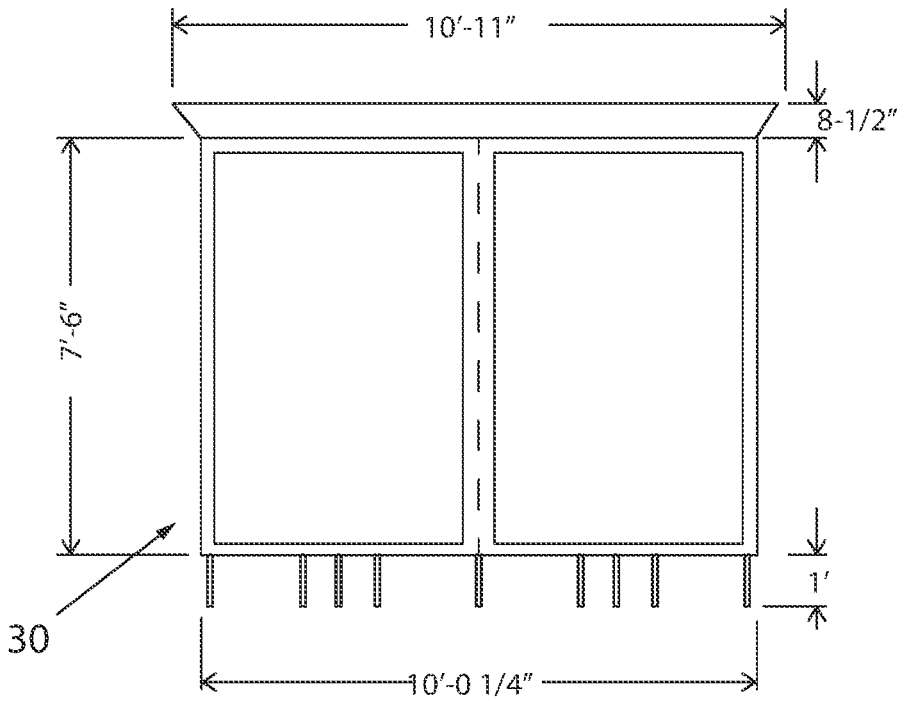
FIG. 27 is a side elevation view of the tent system of FIGS. 25 and 26.
Figure 28:
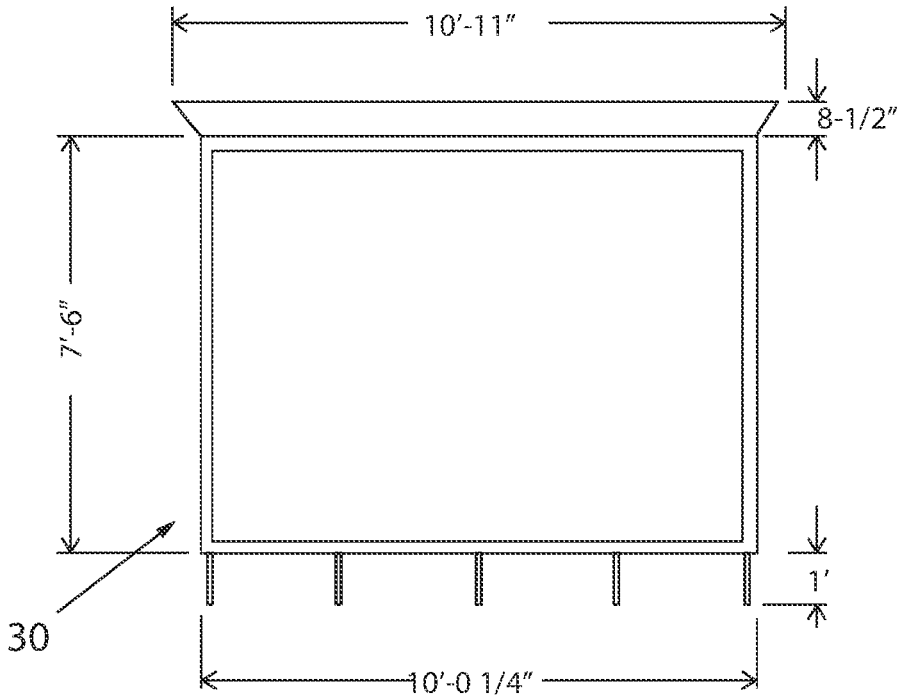
FIG. 28 is a side elevation view of the tent system of FIG. 25-27.

The described stake plates 72 may also be modified for use on hard surfaces. For instance, where the tent 30 is used to surround a hot tub that is on a concrete slab, deck, or other surface, weighted anchor planks 73 may be used that rest on top of that hard surface as shown in FIGS. 22*a* and 22*b*. Similarly, anchor planks 73 may be used on other surfaces such as very loose sand where it would not be possible to secure the bottom ends of sidewalls 36 to the ground using the previously described stake plates 72. Each of the sidewalls 36 may be affixed to the anchor plates 73 to secure the bottom edge of the sidewalls 36 in place. The anchor plates 73 may be made of materials having sufficient weight to prevent the tent 30 from blowing away, and also to prevent an individual located outside the tent 30 from easily lifting up any of the sidewalls 36 along the entire perimeter of the tent 30. For instance, these weighted stake plates 73 may be made of a variety of materials, such as heavy metals, heavy plastics, heavy synthetic materials, and the like. Otherwise, for a more portable version, the anchor plates 73 may be made of a lightweight, hollow material, such as rubber or other plastic materials, that can be filled with water or other liquid. In this embodiment, the hollow anchor plate 23 is placed in a desired location, after which it can be filled with water. Once filled with water, the tent 30 can be constructed around the anchor plates 73. After use of the tent 30 has been completed, the tent 30 may be torn down, after which the anchor plates 73 may be opened to enable the water or other liquid to exit the stake plates 73. Once drainage of the anchor plate 73 has been completed, the anchor plates 73 can easily be transported to another location.

Further still, the tent 30 may come equipped with straps 76 mounted along the top of each sidewall 36. For instance, each sidewall 36 may have four straps 76 mounted thereon. These straps 76 may include clips or male and female buckles (not shown) on either end to allow the strap 76 to be secured to the frame 40.

Figure 3:
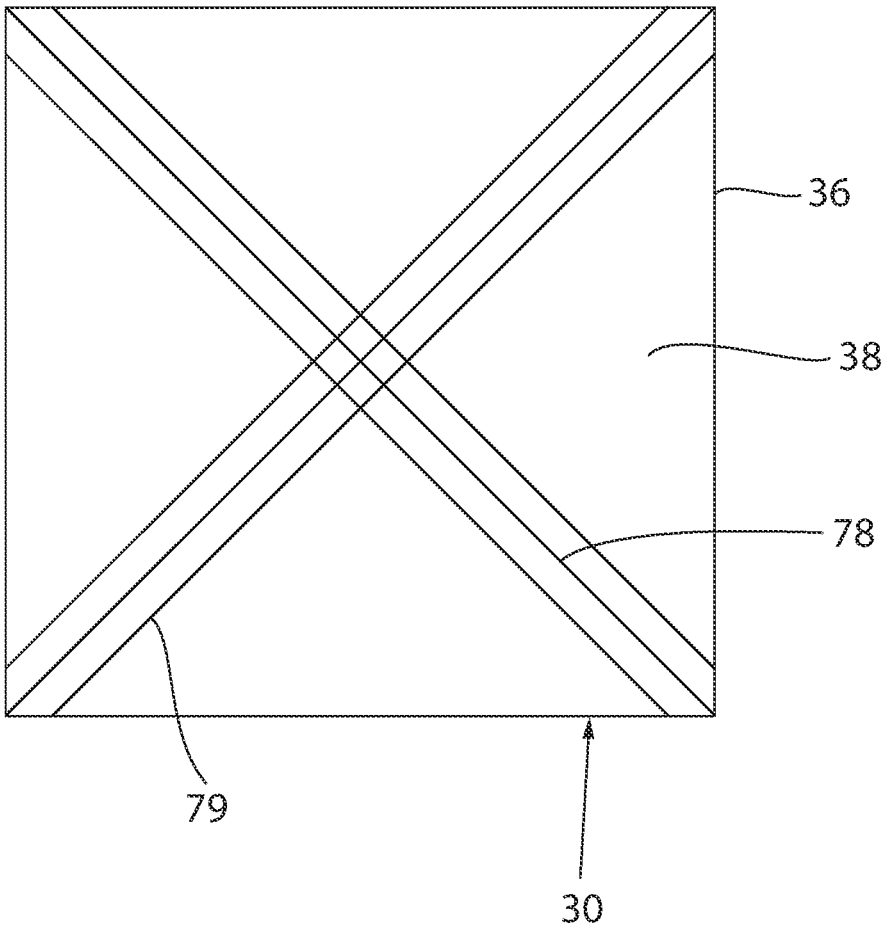
FIG. 3 is a top plan view of the tent system of FIGS. 1 and 2.
Figure 4:
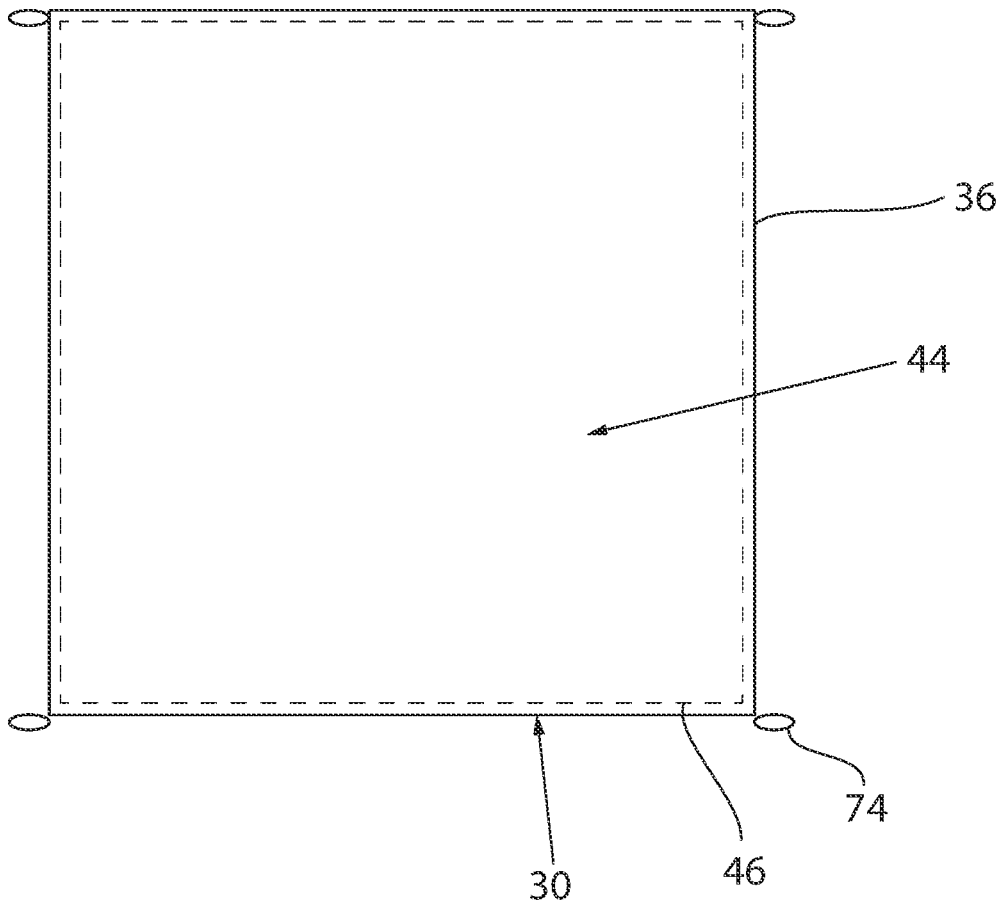
FIG. 4 is a bottom plan view of the tent system of FIGS. 1-3.
Figure 5:
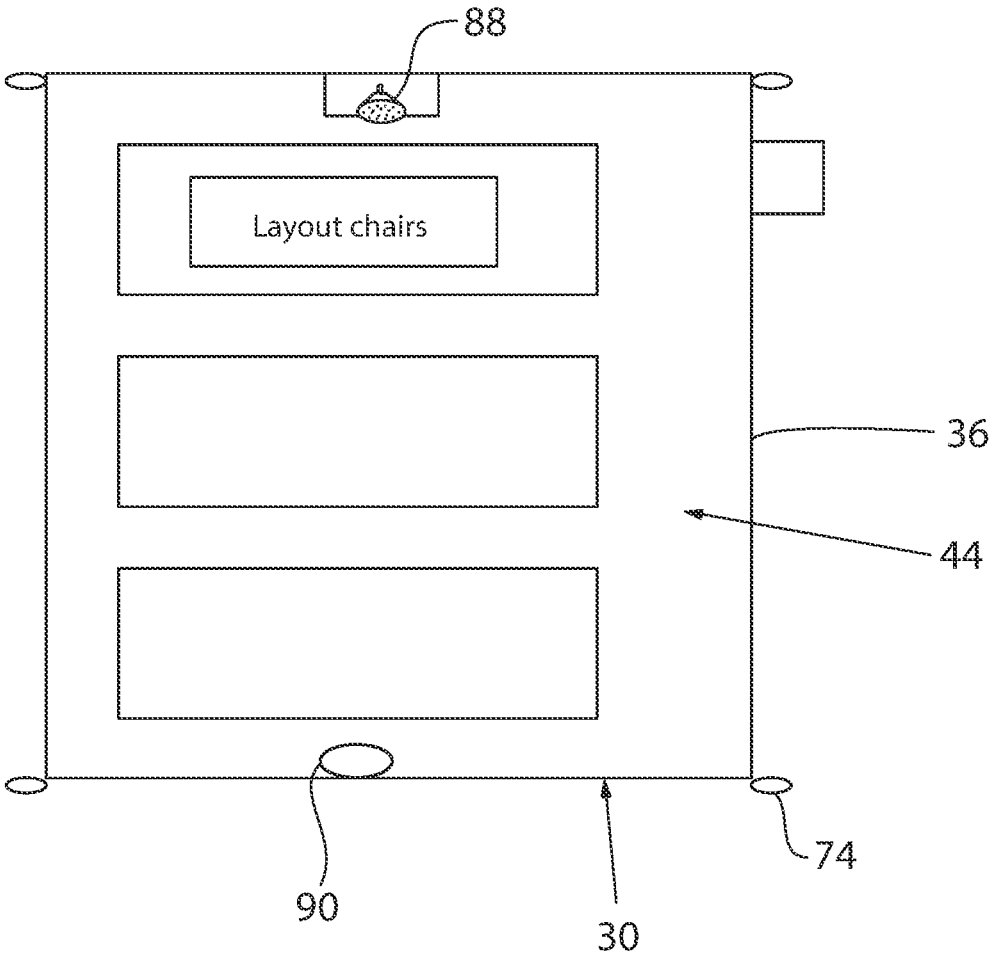
FIG. 5 is a top plan view of the tent system of FIGS. 1-4 with a roof removed.

The tent 30 may come with a frame 40 to which the various sidewalls 36, removable roof 38, and removable floor 44 can be mounted. For instance, the tent 30 may come with an accordion-style canopy tent frame 40 with feet (not shown) and two flexible sectional roof supports 78 that can be used to support the removable roof 38 before it is removed. Where the tent 30 includes the removable floor 44, the feet may be located on or inside of floor 44. The two flexible sectional roof supports 78 may fit into diagonal sleeves 79 included in the roof material and inserted into the corners of the frame 40. In this way, the two flexible sectional roof supports 78 may be diagonally located as shown in FIG. 3. Once the roof 38 is removed, the two flexible sectional roof supports 78 may remain in place. Alternatively, the two flexible sectional roof supports 78 may be removed, while the structural rigidity of the sidewalls 36 is maintained in light of the other frame members in combination with the stakes 70 and stake plates 72. Alternatively still, the sidewalls 36 of the tent 30 may be configured such that they can easily be retrofitted onto frames from existing tents or canopies having a variety of sizes and configurations, including 10 foot by 10 foot tents or canopies. By way of example and not limitation, the sidewalls 36, roof 38, and floor 44 can be fitted onto frames sold with Coleman Instant Eaved Shelters having a variety of different heights. In this way, a purchaser may simply buy the sidewalls 36 and optional roof 38 and floor 44 and use them with the frame 40 of a tent 30 that is already owned. Otherwise, a purchaser may buy a tent 30 having the sidewalls 36 and optional roof 38 and floor 44, as well as the frame 40.

The tent 30 may have other features to further improve functionality and enjoyment by users. For instance, the interior 34 of the tent 30 may include a reflective material to help enhance the amount of sunlight that enters the tent 30, especially when the tent 30 is used for sunbathing. By way of example, various sheets of reflective Faylon material may be mounted about the tent 30. This could include sheets of Faylon material that hang from the top of the sidewalls 36. Also, various storage compartments or netting (not shown) may be provided within the tent 30 to allow users to secure personal materials therein. Additionally, misters or showers 88 may be mounted around the tent 30. For instance, when the tent 30 is used for sunbathing or physical activities, misters or showers may be mounted around the perimeter of the tent 30 and extend therein to provide cooling water to occupants. These misters or showers can be connected to a garden hose (not shown) for easy delivery of water to the mister and/or shower. The tent 30 may also include a variety of lights 90 mounted around the tent 30. This is especially appealing when the tent 30 is used in nighttime conditions, such as in connection with a hot tub. The lights may be built-in outdoor LED lights, battery-powered lights, solar-powered lights, and the like.

It should be understood that the above description, while indicating representative embodiments of the present invention, is given by way of illustration and not of limitation. Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

What is claimed is:

1. A modular privacy tent system comprising:

a frame;

at least one sidewall having a top edge and a bottom edge, the at least one sidewall releasably supported by the frame to form an interior;

a removable roof;

a door formed in one of the at least one sidewall; and at least one zipper clip mounted to the at least one sidewall in the interior wherein the interior has an open top when the removable roof is removed;

wherein the door further comprises a first zipper configured to allow the door to be moved between:

an open position in which access to the interior is permitted; and a closed position in which access to the interior is not permitted;

wherein the zipper clip is configured to secure the zipper in the closed position.

2. The modular privacy tent system of claim 1, wherein the at least one sidewall comprises a first sidewall, a second sidewall, a third sidewall, and a fourth sidewall;

wherein the first sidewall is releasably attachable to the second sidewall and third sidewall; and wherein the fourth sidewall is releasably attachable to the second sidewall and third sidewall.

3. The modular privacy tent system of claim 1, wherein the at least one sidewall comprises a first sidewall, a second sidewall, a third sidewall, a fourth sidewall, a fifth sidewall, and a sixth sidewall;

wherein the first sidewall is releasably attachable to the second and sixth sidewall; and wherein the fourth sidewall is releasably attachable to the third and fifth sidewall.

4. The modular privacy tent system of claim 1, further comprising:

a plurality of openings formed along the bottom edge of the at least one sidewall;

a plurality of stakes releasably insertable into the plurality openings; and at least one anchor plank secured to the ground surface with the plurality of stakes;

wherein the plurality of stakes is inserted through the plurality of openings into the at least one anchor plank in the interior.

5. The modular privacy tent system of claim 4, wherein the plurality of stakes is selected from a group consisting of corkscrew stakes and straight stakes inserted into the at least one anchor plank at opposing angles.

6. The modular privacy tent system of claim 1, further comprising at least one weighted anchor plank rested onto a ground surface;

wherein the bottom edge is secured to the at least one weighted anchor plank in the interior.

7. The modular privacy tent system of claim 6, wherein the weighted anchor plank further comprises:

a body; and an opening formed within the body;

wherein the opening is configured to receive a weighted material.

8. The modular privacy tent system of claim 1, further comprising:

a modesty cloth located behind the door to prevent visual access to the interior when the door is opened.

9. The modular privacy tent system of claim 1, further comprising at least one upper ridge extension lip;

wherein the at least one upper ridge extension lip extends from the upper edge of the at least one sidewall; and wherein the at least one upper ridge extension lip extends upwardly and outwardly from the upper edge.

10. The modular privacy tent system of claim 9, wherein the upper ridge extension lip further comprises:

an extender arm extending from the frame and manipulatable relative to the frame; and a piece of flexible fabric;

wherein the upper ridge extension lip is movable relative to the frame.

11. The modular privacy tent system of claim 1, further comprising:

at least one mister mounted to the top edge of the at least one sidewall; and a water source connected to the at least one mister;

wherein the at least one mister sprays water into the interior.

12. The modular privacy tent system of claim 1, further comprising at least one light mounted to the at least one sidewall.

13. The modular privacy tent system of claim 1, wherein the frame further comprises at least one removable roof support member.

14. A modular privacy tent system, comprising:

a frame;

at least one sidewall having a top edge and a bottom edge, the at least one sidewall releasably supported by the frame to form an interior;

a removable roof, wherein the interior has an open top when the removable roof is removed; and at least one window formed in one of the at least one sidewalls comprising:

a first window covering comprising a portion of the at least one sidewall;

a second window covering comprising a screen; and a third window covering comprising a modesty cloth;

wherein the second window covering is located between the first window covering and the third window covering; and wherein the modesty cloth prevents visual access to the interior when the first window covering is released.

15. The modular privacy tent of claim 14, further comprising at least one upper ridge extension lip;

wherein the at least one upper ridge extension lip extends from the upper edge of the at least one sidewall; and wherein the at least one upper ridge extension lip extends upwardly and outwardly from the upper edge.

16. The modular privacy tent of claim 14, further comprising:

a plurality of openings formed along the bottom edge of the at least one sidewall;

a plurality of stakes releasably insertable into the plurality openings; and at least one anchor plank secured to the ground surface with the plurality of stakes;

wherein the plurality of stakes is inserted through the plurality of openings into the at least one anchor plank in the interior.

17. The modular privacy tent of claim 14, further comprising at least one weighted anchor plank rested onto a ground surface;

wherein the bottom edge is secured to the at least one weighted anchor plank in the interior.

18. A method of assembling a modular privacy tent system comprising the steps of:

assembling a frame;

mounting at least one sidewall to the frame;

securing at least one stake plate onto a ground surface; and driving at least one stake through a bottom edge of the at least one sidewall into the stake plate at an interior of the sidewall, wherein driving at least one stake further comprises:

driving a first stake through the bottom edge of the sidewall at a first angle; and driving a second stake through the bottom edge of the sidewall at a second angle;

wherein the first angle and the second angle are at least 30 degrees offset from one another;

releasably attaching a removable roof to the frame; and removing the removable roof to create an open top.

19. The method of claim 18, further comprising the step of releasably attaching a first side edge of one of the at least one sidewall to a second side edge of another of the at least one sidewall.

20. The method of claim 18, further comprising the steps of:

locating a weighted anchor plank adjacent to the frame;

filling an opening in the weighted anchor plank with a weighted material; and driving the at least one stake through the bottom edge of the at least one sidewall into the weighted anchor plank.

* * * * *